US006784866B2

(12) United States Patent
Udo et al.

(10) Patent No.: US 6,784,866 B2
(45) Date of Patent: Aug. 31, 2004

(54) DOT-INVERSION DATA DRIVER FOR LIQUID CRYSTAL DISPLAY DEVICE

(75) Inventors: Shinya Udo, Kawasaki (JP); Masatoshi Kokubun, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 127 days.

(21) Appl. No.: 09/824,345

(22) Filed: Apr. 2, 2001

(65) Prior Publication Data

US 2002/0050972 A1 May 2, 2002

(30) Foreign Application Priority Data

Oct. 31, 2000 (JP) ..... 2000-333517

(51) Int. Cl.[7] ..... G09G 3/36
(52) U.S. Cl. ..... 345/100; 345/88; 345/98
(58) Field of Search ..... 345/88–100, 103, 345/204

(56) References Cited

U.S. PATENT DOCUMENTS

| | | | | |
|---|---|---|---|---|
| 5,528,256 A | | 6/1996 | Erhart et al. | 345/96 |
| 5,875,015 A | * | 2/1999 | Fujiyoshi | 345/98 |
| 5,995,073 A | * | 11/1999 | Isami et al. | 345/98 |
| 6,049,321 A | | 4/2000 | Sasaki | 345/99 |
| 6,064,363 A | | 5/2000 | Kwon | 345/98 |
| 6,157,358 A | * | 12/2000 | Nakajima et al. | 345/96 |
| 6,229,512 B1 | * | 5/2001 | Shigehiro | 345/98 |
| 6,304,241 B1 | * | 10/2001 | Udo et al. | 345/96 |
| 6,441,758 B1 | * | 8/2002 | Koyama et al. | 341/136 |

FOREIGN PATENT DOCUMENTS

| | | |
|---|---|---|
| JP | 2955851 | 2/1989 |
| JP | 9-159992 | 6/1997 |
| JP | 10-133174 | 5/1998 |
| JP | 2000-98976 | 4/2000 |
| JP | 2000-172231 | 6/2000 |

* cited by examiner

*Primary Examiner*—Bipin Shalwala
*Assistant Examiner*—David L. Lewis
(74) *Attorney, Agent, or Firm*—Greer, Burns & Crain, Ltd.

(57) ABSTRACT

In a data driver 10A of a dot-inversion driving type, the outputs of voltage buffer amplifiers B1 to B12 are connected to respective data bus lines D1 to D12 of a LCD panel, short-circuiting switches S1, S3, S5, S7, S9 and S11 are connected between ones of every other adjacent data bus lines concerned with the same display color, and interconnecting lines on first and second rows are arranged in a staggered configuration. These short-circuiting switches are formed at one sides of every other data bus lines, and turned on by a control circuit 13 when the outputs of the voltage buffer amplifier are in a high impedance state.

12 Claims, 11 Drawing Sheets

FIG.2(A)

| | | | | | |
|---|---|---|---|---|---|
| + | − | + | − | + | − |
| − | + | − | + | − | + |
| + | − | + | − | + | − |
| − | + | − | + | − | + |

FIG.2(B)

| | | | | | |
|---|---|---|---|---|---|
| − | + | − | + | − | + |
| + | − | + | − | + | − |
| − | + | − | + | − | + |
| + | − | + | − | + | − |

DOT-INVERSION DATA DRIVER FOR LIQUID CRYSTAL DISPLAY DEVICE

BACKGROUND OF THE INVENTION

1. Field of the Invention

The present invention relates to a data driver for a liquid crystal display device, comprising voltage buffer amplifiers each outputting an analog gradation voltage, applying the analog gradation voltages to data bus lines such that voltage polarities of adjacent data bus lines concerned with a same display color are inverse to each other, and more particularly, to a data driver for driving the data bus lines of a liquid crystal display device in a dot inversion fashion regarding time and space.

2. Description of the Related Art

FIG. 8 shows the output stage of a prior art data driver 10X connected to the data bus lines of a liquid crystal display (LCD) panel.

The voltage buffer amplifiers B1 to B12 of the data driver 10X are respective voltage followers, and the outputs thereof are connected to the respective data bus lines D1 to D12 of the LCD panel. The data driver 10X drives the data bus lines in a dot inversion fashion regarding time and space. That is, voltages applied to adjacent data bus lines at the same time have inverse polarities to each other, and analog gradation voltages corresponding to display data are outputted from the respective voltage buffer amplifiers B1 to B12 such that voltage polarity of each data bus line is inverted every horizontal period. According to the dot-inversion driving technique, potential variations of a pixel electrode caused by cross capacitance between a data bus line and a scan bus line can be effectively canceled and further, a common potential of the opposite electrode can be stabilized, resulting in reducing a flicker.

However, charge and discharge currents of each of the voltage buffer amplifiers B1 to B12 are relatively large, leading to higher power consumption.

Facing such a disadvantage, in order to effectively utilize electric charge accumulated on the data bus lines and decrease power consumption, short-circuiting switches S1 to S12 are connected between a common line CL and the respective data bus lines D1 to D12. When the outputs of the voltage buffer amplifiers B1 to B12 are rendered to be in a high impedance state during a horizontal blanking period, the short-circuiting switches S1 to S12 are simultaneously turned on. Thereby, potentials of the data bus lines D1 to D12 are rendered to be nearly equal to the common potential of the opposite plane electrode of the liquid crystal display panel, enabling a current to be consumed in the voltage buffer amplifiers B1 to B12 to reduce up to a half.

However, since a necessity arises that the short-circuiting switches are provided to the respective voltage buffer amplifiers, an occupied area of the data driver 10X increases, thereby disturbing higher density of data bus lines in arrangement.

FIG. 9 shows a data driver 10Y of a dot inversion driving type disclosed in JP 10-282940 A.

In this circuit, short-circuiting switches S1 to S9 are connected between every other adjacent data bus lines. With this circuit, since the number of the short-circuiting switches is reduced to a half that of FIG. 8, the above described problem can be solved.

However, since different color signals are provided onto adjacent bus lines, there is no correlation therebetween and an efficiency of utilization of electric charge accumulated on the data bus lines is not so satisfactory. For example, potentials of the data bus lines D1 to D6 are distributed in a horizontal period as shown in FIG. 10, and when the short-circuiting switches S1, S3 and S5 turns on in the next horizontal blanking period, the potentials are distributed as shown in FIG. 11 to produce differences between each potential of the data bus lines and the common potential VCOM of the opposite electrode, which increases power consumption of the data driver 10Y compared with the case of FIG. 8. Further, the differences become a cause for variations in the common potential VCOM, resulting in generation of a flicker.

SUMMARY OF THE INVENTION

Accordingly, it is an object of the present invention to provide a data driver for a liquid crystal display device, capable of not only suppressing increase in circuit area but also reducing power consumption together with alleviating a flicker.

In a first aspect of a data driver for a liquid crystal display device according to the present invention, short-circuiting switches are intermittently connected between adjacent data bus lines concerned with a same display color, and the short-circuiting switches are turned on when the outputs of the voltage buffer amplifiers or locations between the voltage buffer amplifiers and the respective data bus lines are in a high impedance state.

Pixel data signals in the adjacent same color have inverse polarities, and it is a high probability that absolute values thereof are nearly equal. Particularly, this probability is higher in a region of a background image. Hence, with this data driver for a liquid crystal display device, by turning on the short-circuiting switches, the potentials of the data bus lines become nearly equal to a common potential of the opposite electrode of a LCD panel, whereby a current to be consumed in the voltage buffer amplifiers can be reduced more than in a case where short-circuiting switches are intermittently connected between adjacent data bus lines.

Further, since the common potential is stabilized, a flicker is alleviated, and thereby an image quality is improved compared with a case where short-circuiting switches are intermittently connected between adjacent data bus lines.

In addition, since the number of the short-circuiting switches is smaller than a case where a short-circuiting switch is connected between each adjacent data bus lines, the circuit area of the data driver can be reduced.

In a second aspect of a data driver for a liquid crystal display device according to the present invention, the short-circuiting switches are connected through interconnecting lines arranged in first and second rows in a staggered configuration in the above described first aspect.

With this data driver for a liquid crystal display device, since the short-circuiting switches and the interconnecting lines for them are arranged such that the densities thereof are nearly uniform, the circuit area of the data driver can be narrower, and the higher density of the data bus lines can be realized.

In a third aspect of a data driver for a liquid crystal display device according to the present invention, the short-circuiting switches are formed at one side of every other data bus lines in the above described second aspect.

With this configuration, the above-described effect is further enhanced.

Other aspects, objects, and the advantages of the present invention will become apparent from the following detailed description taken in connection with the accompanying drawings.

BRIEF DESCRIPTION OF THE DRAWINGS

FIGS. 2(A) and 2(B) are illustrations showing pixel voltage polarity distributions of odd and even frames, respectively.

DESCRIPTION OF THE PREFERRED EMBODIMENTS

Figure 1:
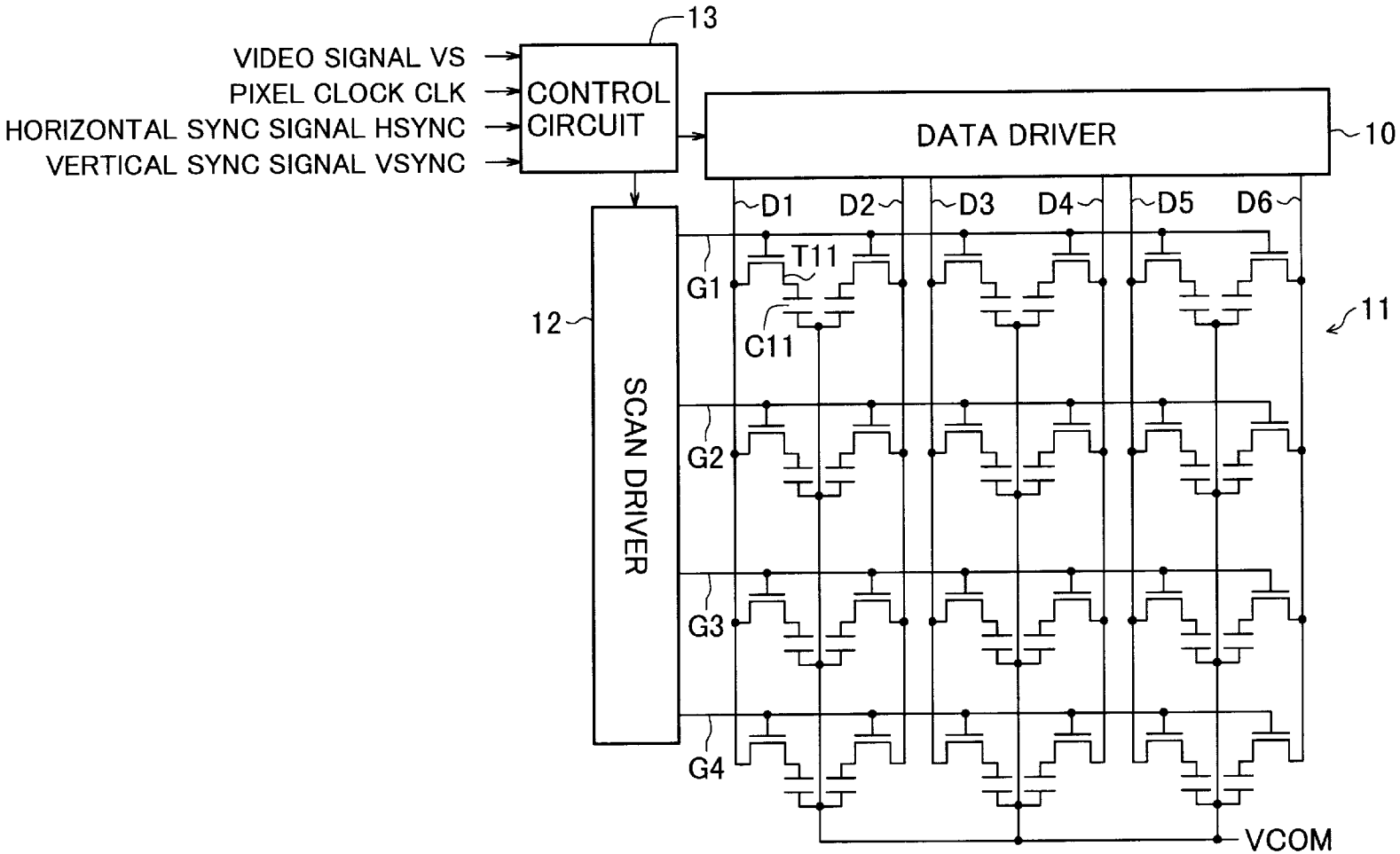
FIG. 1 is a schematic circuit diagram showing a liquid crystal display device of a first embodiment according to the present invention.

Referring now to the drawings, wherein like reference characters designate like or corresponding parts throughout several views, preferred embodiments of the present invention are described below.

First Embodiment

FIG. 1 schematically shows a liquid crystal display device of a first embodiment according to the present invention. In FIG. 1, there is shown a LCD panel 11 having a pixel matrix in 4 rows and 6 columns for simplification.

In the LCD panel 11, a pair of opposed glass substrates, not shown, are disposed, and a gap therebetween is filled with a liquid crystal and sealed. Pixel electrodes are arranged in a matrix on one of the glass substrates, thin film transistors are formed for the respective pixels, scan bus lines (gate lines) G1 to G4 are formed for respective first to fourth rows of the thin film transistors, and data bus lines D1 to D6 are formed for first to sixth columns of the thin film transistors, wherein the scan bus lines G1 to G4 and the data bus lines D1 to D6 cross each other with an insulating film interposing therebetween. On the other glass substrate, a transparent plane electrode in common with all the pixels is formed and a common potential VCOM is applied thereto. For example, in regard to a liquid crystal pixel C11 of the first row and the first column, a thin film transistor T11 is connected between the pixel electrode and the data bus line D1, the gate of the thin film transistor T11 is connected to the scan bus line G1, and the common potential VCOM is applied to the opposite electrode of the liquid crystal pixel C11.

The data bus lines D1 to D6 of the LCD panel 11 are connected to the outputs of the data driver 10 and the scan lines G1 to G4 of the LCD panel 11 are connected to the outputs of a scan driver 12.

A control circuit 13 receives a video signal VS, a pixel clock CLK, a horizontal sync signal HSYNC, and a vertical sync signal VSYNC, and generates timing signals to provide to the data driver 10 and the scan driver 12, and provides a video signal to the data driver 10.

The scan bus lines G1 to G4 are line-sequentially activated by the scan driver 12, while signal charges for pixels on a selected row are renewed by the data driver 10. The data driver 10 simultaneously provides display data signals of a row onto the data bus lines D1 to D6, and renews the signals in each horizontal period.

The data driver 10 drives in a dot inversion fashion. That is, the data driver 10 provides analog gradation voltages according to display data such that voltage polarities of adjacent data bus lines are inverse to each other and a voltage polarity of each data bus line is inverted every horizontal period. FIGS. 2(A) and 2(B) show pixel voltage polarity distributions of odd and even frames, respectively.

Figure 3:
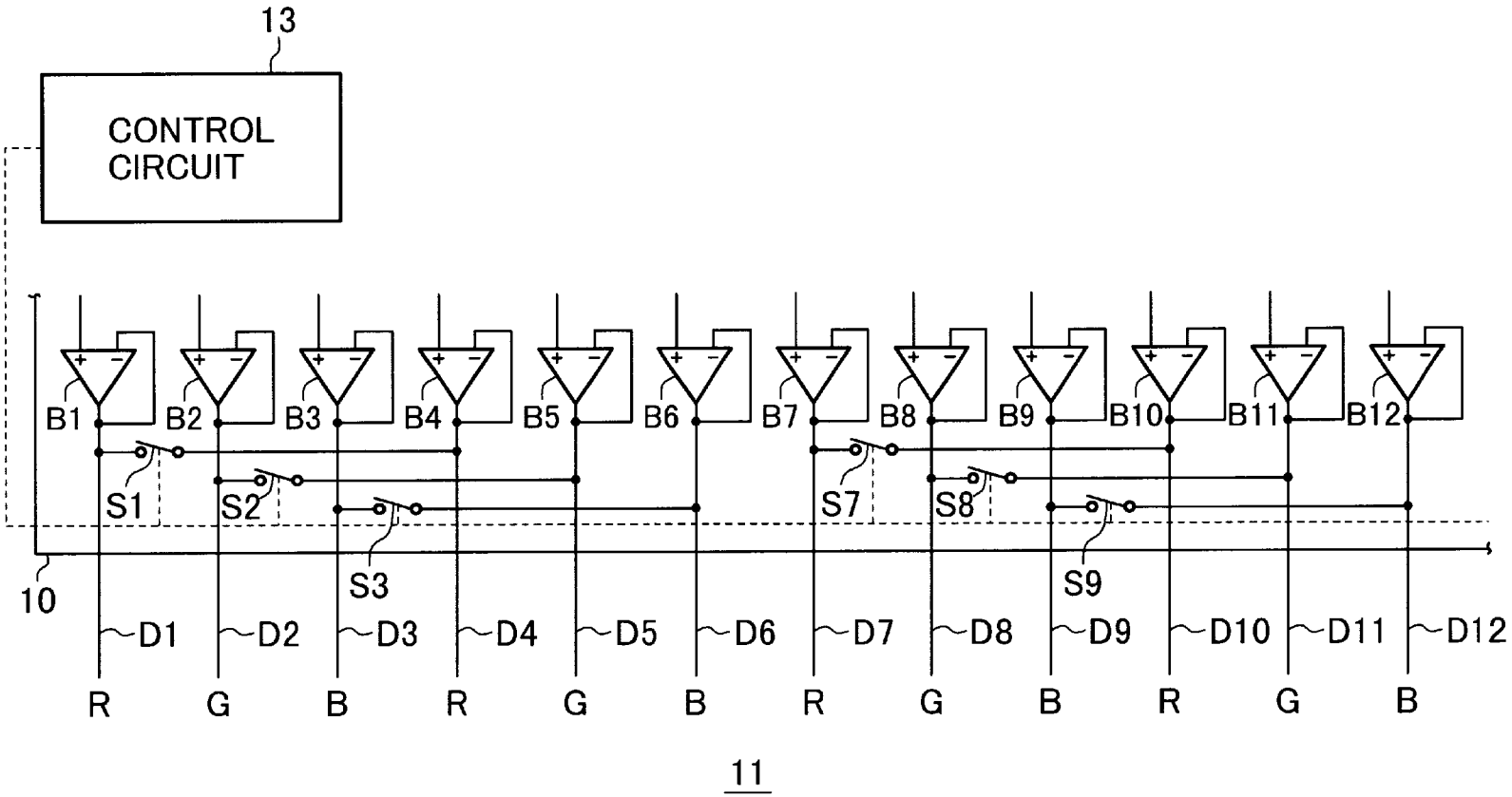
FIG. 3 is a circuit diagram showing an output stage of the data driver of FIG. 1.

FIG. 3 shows the output stage of the data driver 10. The number of data bus lines is actually, for example, 1024×3=3072, and FIG. 3 shows only data bus lines D1 to D12 as part thereof.

The data bus lines D1 to D12 on the LCD panel 11 are respectively connected to outputs of voltage buffer amplifiers B1 to B12 of the data driver 10, and each voltage buffer amplifier is constituted of a voltage follower. Data bus lines of each of red (R), green (G), and blue (B) color signals are arranged every three lines.

Short-circuiting switches are connected between ones of every other adjacent data bus lines concerned with the same display color. That is, the short-circuiting switch S1 is connected between adjacent R data bus lines D1 and D4, no short-circuiting switch is connected between the next adjacent R data bus lines D4 and D7, and a short-circuiting switch S7 is connected between the still next adjacent R data bus lines D7 and D10. Likewise, a short-circuiting switch S2 is connected between adjacent G data bus lines D2 and D5, and a short-circuiting switch S8 is connected between adjacent G data bus lines D8 and D11. Further, a short-circuiting switch S3 is connected between adjacent B data bus lines D3 and D6, and a short-circuiting switch S9 is connected between adjacent B data bus lines D9 and D12.

A control circuit 13 puts the outputs of the voltage buffer amplifiers B1 to B12 into a high impedance state during each of successive horizontal blanking periods, and during each period, turns on all the short-circuiting switches S1 to S3 and S7 to S9.

Figure 8:
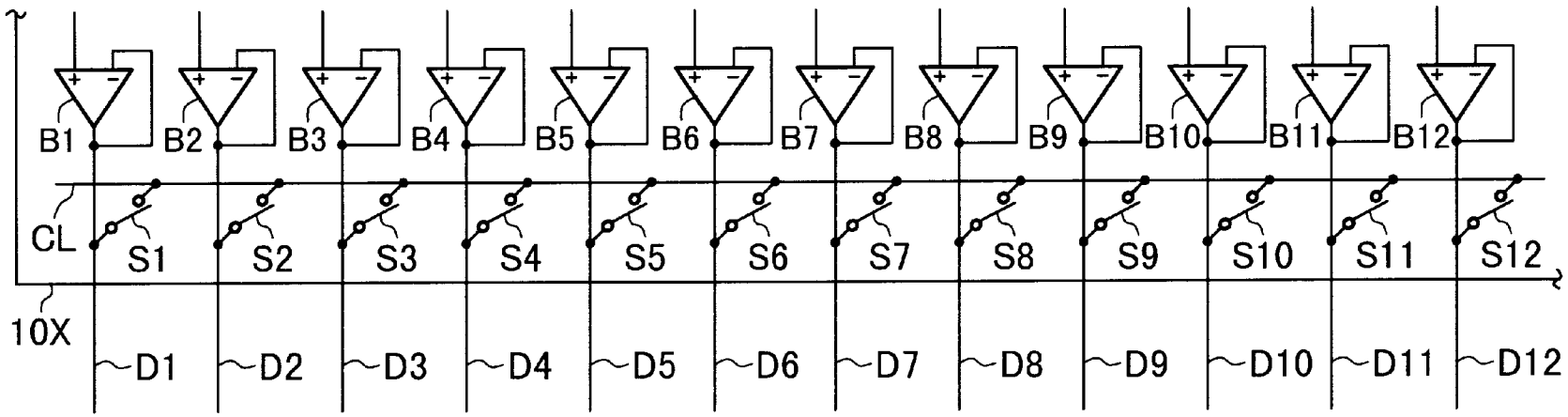
FIG.8 prior art
FIG. 8 is a circuit diagram showing an output stage of a prior art data driver connected to data bus lines of a LCD panel.
Figure 9:
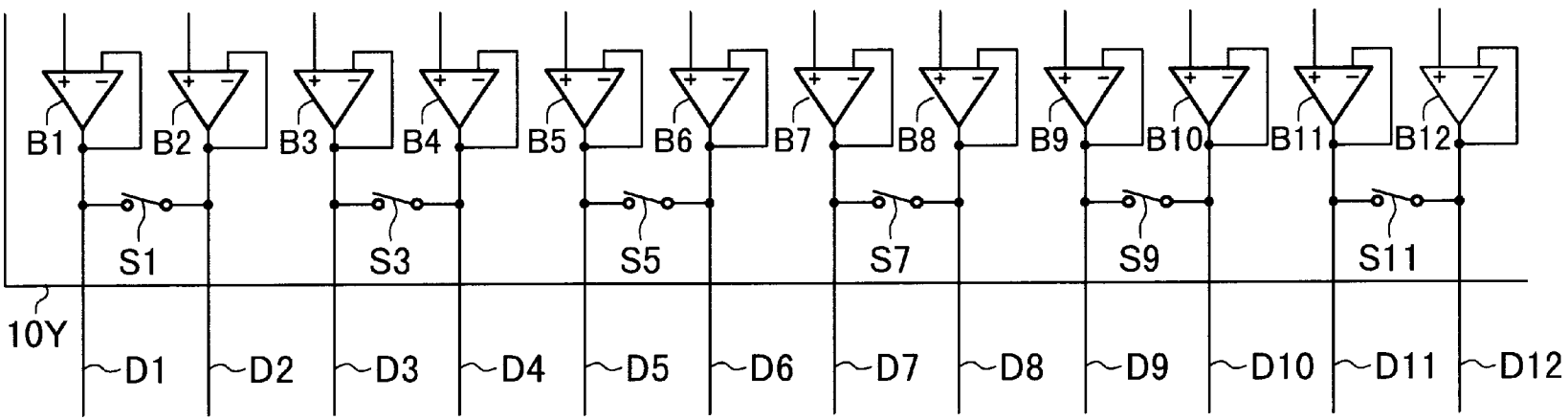
FIG.9 prior art
FIG. 9 is a circuit diagram showing an output stage of another prior art data driver.
Figure 10:
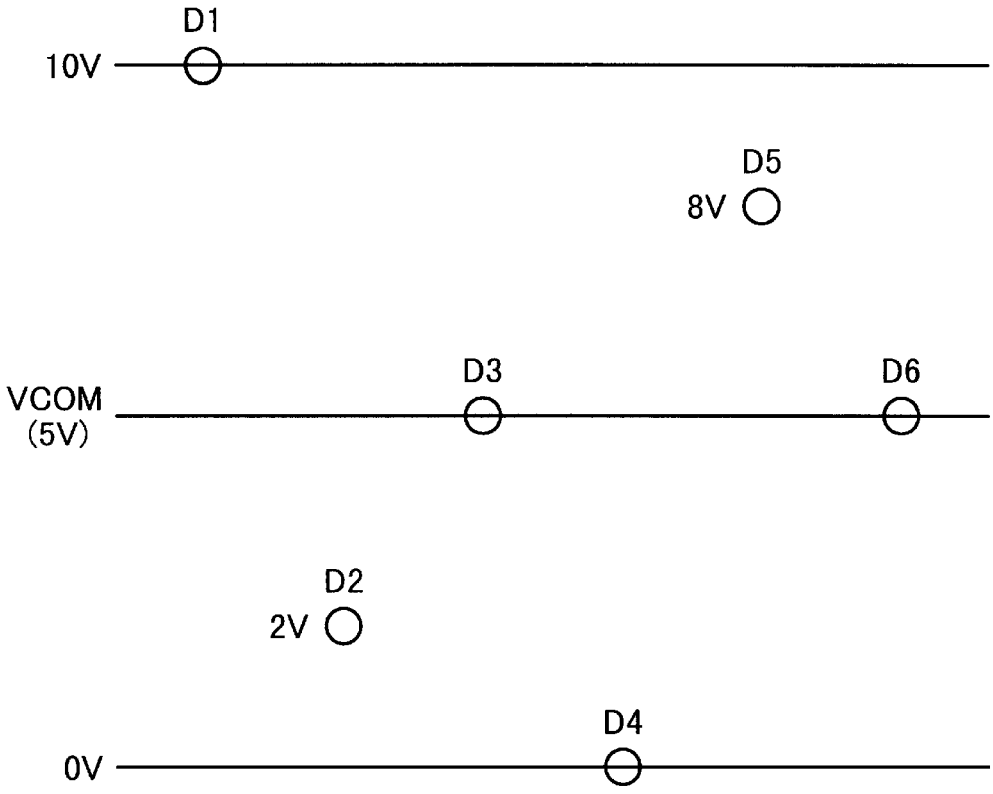
FIG.10 prior art
FIG. 10 is an illustration of potentials of the data bus lines D1 to D6 of FIG. 9 during a horizontal period.
Figure 11:
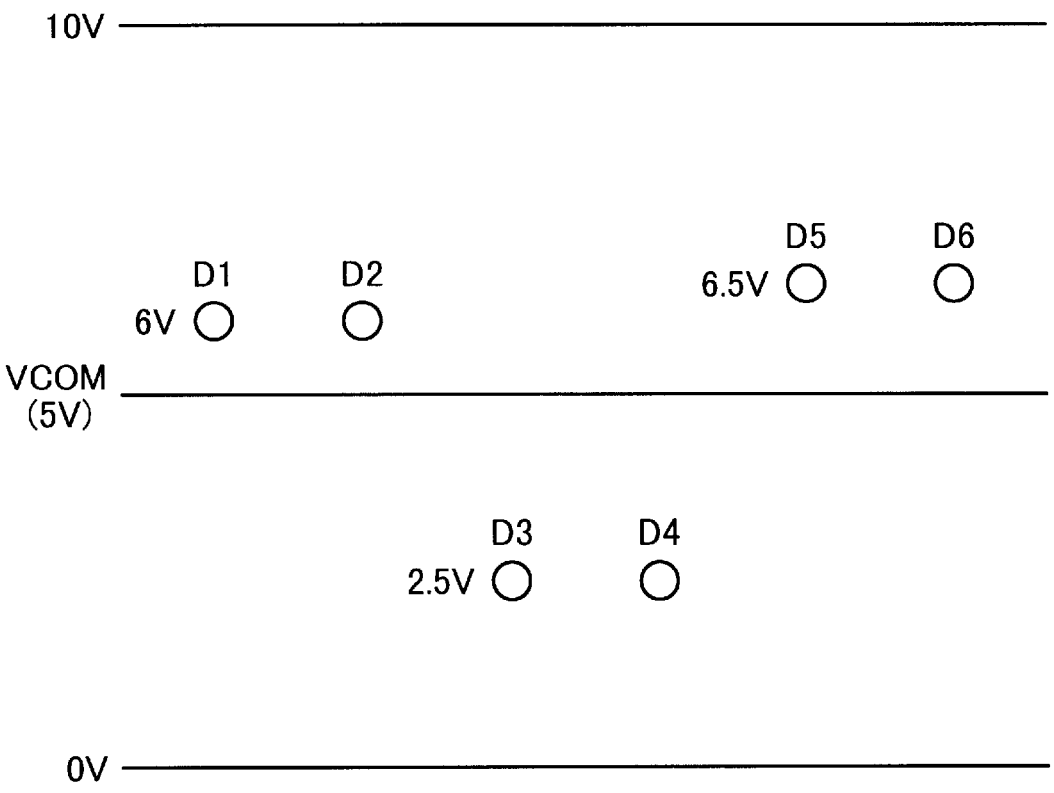
FIG.11 prior art
FIG. 11 is an illustration of potentials of the data bus lines D1 to D6 after short-circuiting switches between the data bus lines are turned on from the state of FIG. 10.

Adjacent pixel data signals of the same color have inverse polarities to each other, and the absolute values thereof are almost the same as each other with a high probability. Particularly, this probability is higher in the region of a background image. Therefore, the potentials of the data bus lines D1 to D12 are rendered to be almost equal to the common potential VCOM when short-circuited, and currents consumed in the voltage buffer amplifiers B1 to B12 can be reduced to almost a half that of a case where no short-circuiting switch is connected. Further, the common potential VCOM of the opposite electrode is prevented from varying by capacitive coupling, and thereby a flicker is reduced compared with the case of FIG. 9. Furthermore, since the number of the short-circuiting switches is a half that of the case of FIG. 8, a circuit area of the data driver 10 can be reduced, enabling higher data bus line density to be achieved.

Second Embodiment

Figure 4:
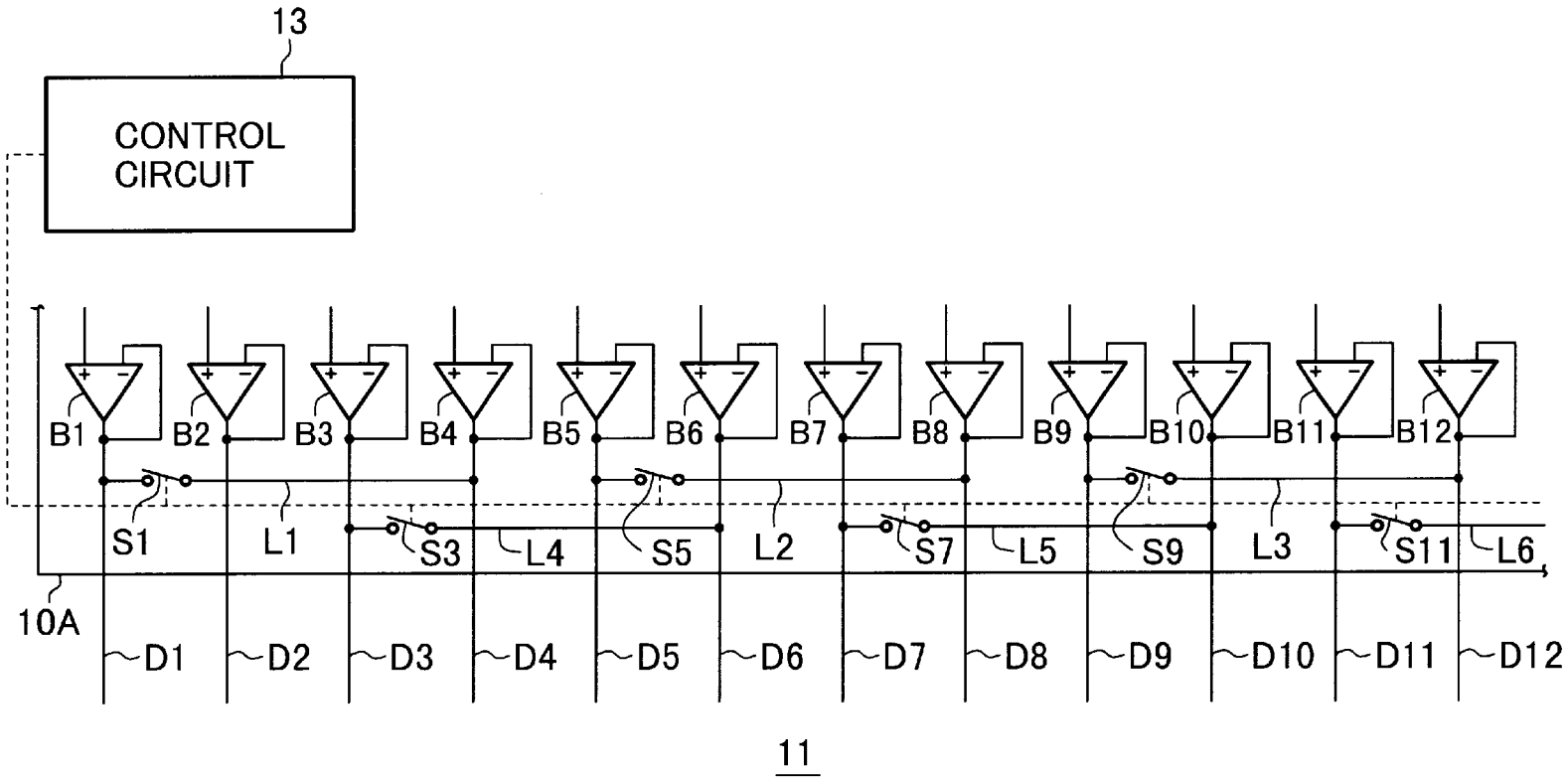
FIG. 4 is a circuit diagram showing an output stage of a data driver of a second embodiment according to the present invention.

FIG. 4 shows an output stage of a data driver 10A of a second embodiment according to the present invention.

In this circuit, interconnecting lines L1 to L3 for connecting short-circuiting switches S1, S5 and S9 on a first row and interconnecting lines L4 to L6 for connecting short-circuiting switches S3, S7 and S11 on a second row are arranged in a staggered configuration.

In each of these first and second rows, one ends of adjacent short-circuiting switches are connected to respective adjacent data bus lines: that is, one ends of the short-circuiting switches S1 and S5 are connected to the respective data bus lines D4 and D5, one ends of the short-circuiting switches S5 and S9 are connected to the respective data bus lines D8 and D9, one ends of the short-circuiting switches S3 and S7 are connected to the respective data bus lines D6 and D7, and one ends of the short-circuiting switches S7 and S11 are connected to the respective data bus lines D10 and D11.

The short-circuiting switches S1, S3, S5, S7, S9 and S11 are controlled by the control circuit 13 in a similar manner to the above-described first embodiment.

According to the second embodiment, a similar effect to that of the first embodiment is obtained. Furthermore, since interconnecting lines for short-circuiting switches are arranged only in the first and second rows such that the density of interconnecting lines is roughly uniform, and the arrangement density of short-circuiting switches is also roughly uniform, the area of the data driver 10A can be smaller than that of the case of FIG. 3 with placing data bus lines in higher density.

Third Embodiment

Figure 5:
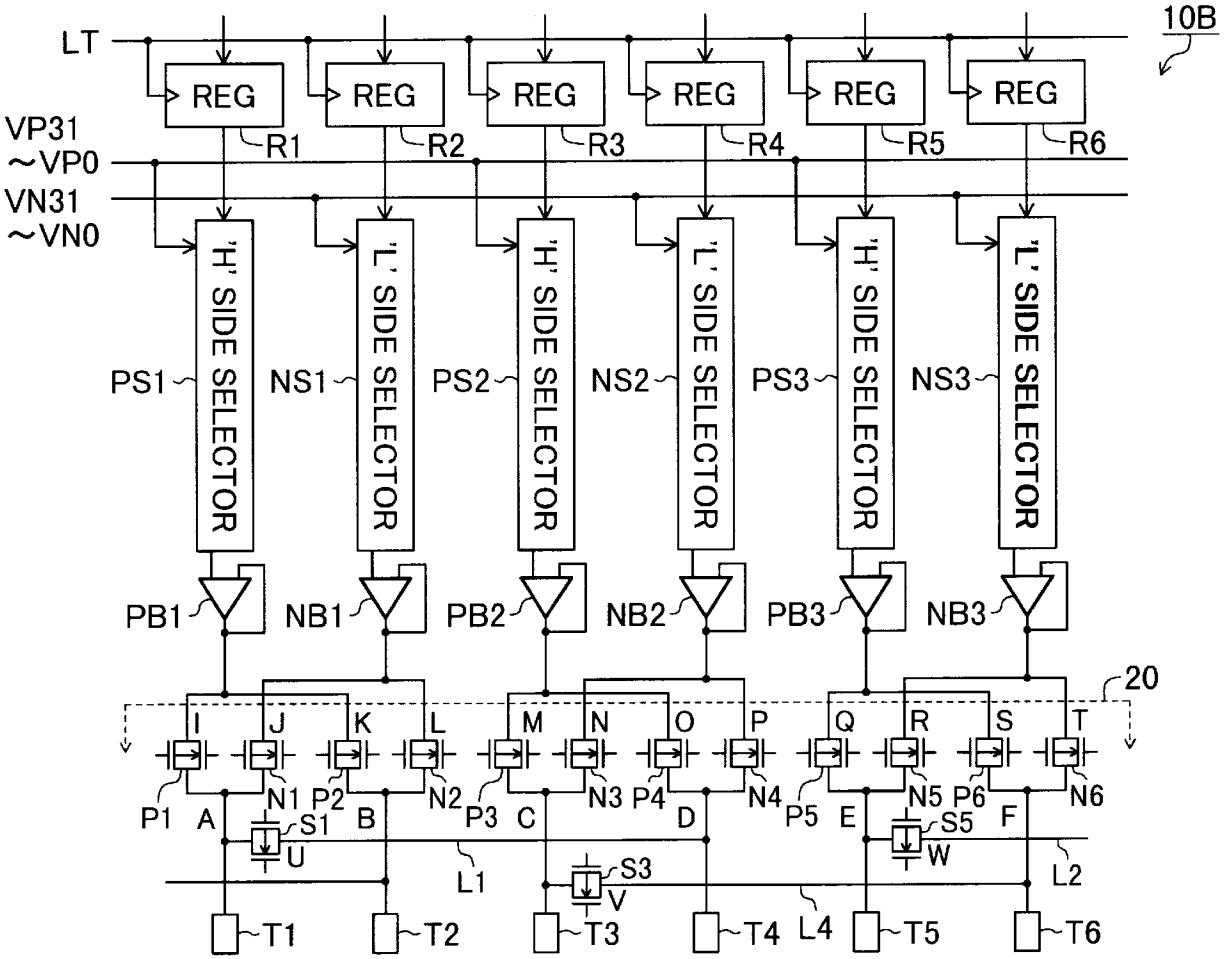
FIG. 5 is a circuit diagram showing part of a data driver of a third embodiment according to the present invention.

FIG. 5 shows part of a data driver 10B of a third embodiment according to the present invention.

Positive-polarity voltage buffer amplifiers PB1 to PB3 each are for providing higher ('H' side) voltages than the common potential VCOM (for example, 5V), while negative-polarity voltage buffer amplifiers NB1 to NB3 each are for providing lower ('L' side) voltages than the common voltage VCOM. The reason why the two types of the voltage buffer amplifiers are employed, one being for use in the 'H' side and the other being for use in 'L' side, is to realize a narrower output amplitude so as to simplify the configuration thereof.

In order to provide the outputs of the positive-polarity voltage buffer amplifier PB1 and the negative-polarity voltage buffer amplifier NB1 to each of the output terminals T1 and T2 alternately in each successive horizontal period (1 H), transfer gates P1 and P2 are connected between the output of the positive-polarity voltage buffer amplifier PB1 and the respective output terminals T1 and T2, and transfer gates N1 and N2 are connected between the output of the negative-polarity voltage buffer amplifier NB1 and the respective output terminals T1 and T2. Transfer gates P1, P2, N1, and N2 constitute one set of changeover switches. This applies to changeover switches between other voltage buffer amplifiers and corresponding output terminals in a similar way. Between these changeover switches and the output terminals T1 to T6, the short-circuiting switches S1, S3 and S5 are connected in a similar manner to the case of FIG. 4.

Figure 6:
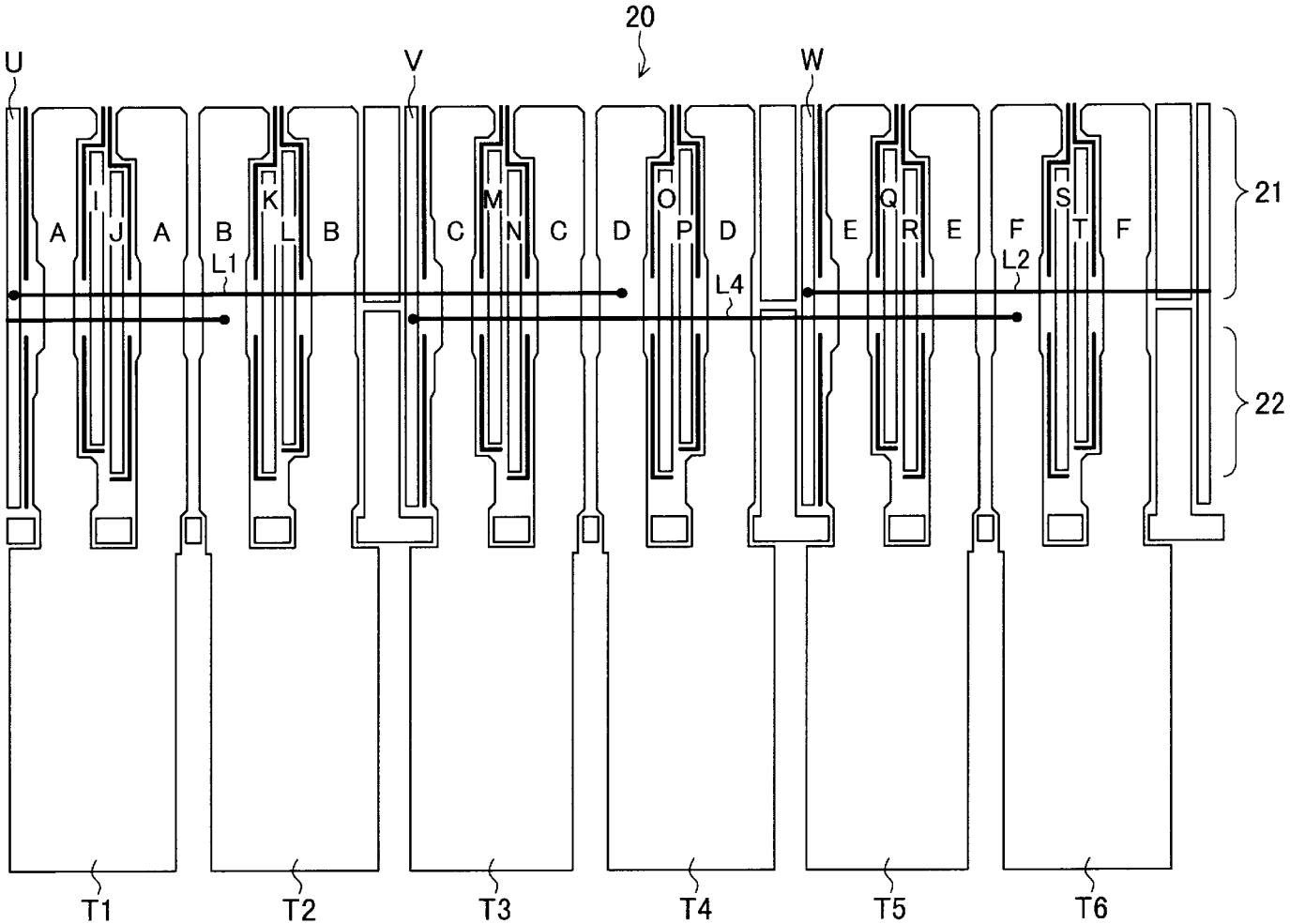
FIG. 6 is a layout view of part in FIG. 5 lower than a short dashed line.

FIG. 6 shows a circuit layout of part 20 in FIG. 5 lower than a short dashed line. In FIG. 6, electrodes A to F, I to T, and U to W correspond to respective locations indicated by the same reference characters in FIG. 5.

Each of the transfer gates of FIG. 5 has a PMOS transistor and an NMOS transistor connected in parallel to each other, and the PMOS transistors are formed in a region 21 and the NMOS transistors are formed in a region 22.

For example, the PMOS transistor of the transfer gate P1 has the electrodes A and I, and a gate drawn by a thick black line therebetween, and the PMOS transistor of the transfer gate N1 has the electrodes A and J, and a gate drawn by a thick black line therebetween. The NMOS transistors of the transfer gates P1 and N1 have portions corresponding to those, in the NMOS transistor region 22.

The PMOS transistor of the short-circuiting switch S1 has the electrodes A and U, and a gate drawn by a thick black line therebetween, the PMOS transistor of the short-circuiting switch S3 has the electrodes C and V, and a gate drawn by a thick black line therebetween, and the PMOS transistor of the short-circuiting switch S5 has the electrodes E and W, and a gate drawn by a thick black line therebetween. Likewise, the NMOS transistors of the short-circuiting switches S1, S3 and S5 have portions corresponding to those, in the NMOS transistor region 22. The electrode U is connected to the electrode D through the interconnecting line L1 on a first row, the electrode V is connected to the electrode F through an interconnecting line L4 on a second row, and the electrode W is connected to an interconnecting line L5 on the first row. In FIG. 6, these interconnecting lines L1, L4 and L2 in an upper wiring layer not shown are simply drawn.

Since the short-circuiting switches are formed at one sides of every other data bus lines, and the interconnecting lines L1, L4 and L5 for connecting the short-circuiting switches are arranged only on the first and second rows between the PMOS transistor region 21 and the NMOS transistor region 22 such that the density of interconnecting lines is nearly uniform, the area of the circuit 20 can be narrowed and the output terminals T1 to T6, which are considered to be part of the respective data bus lines, can be arranged in higher density.

Referring back to FIG. 5, each of positive-polarity voltage selectors PS1 to PS3 selects one of positive-polarity gradation voltages VP31 to VP0 according to the corresponding output value of respective registers R1, R3 and R5 to provide it to corresponding one of the respective positive-polarity voltage buffer amplifiers PB1 to PB3. Likewise, each of the negative-polarity voltage selectors NS1 to NS3 selects one of negative-polarity gradation voltages VN31 to VNO according to the corresponding output values of respective registers R2, R4 and R6 to provide it to corresponding one of the respective negative-polarity voltage buffer amplifiers NB1 to NB3. To the clock inputs of the registers R1 to R6, a latch signal LT is provided.

Figure 7:
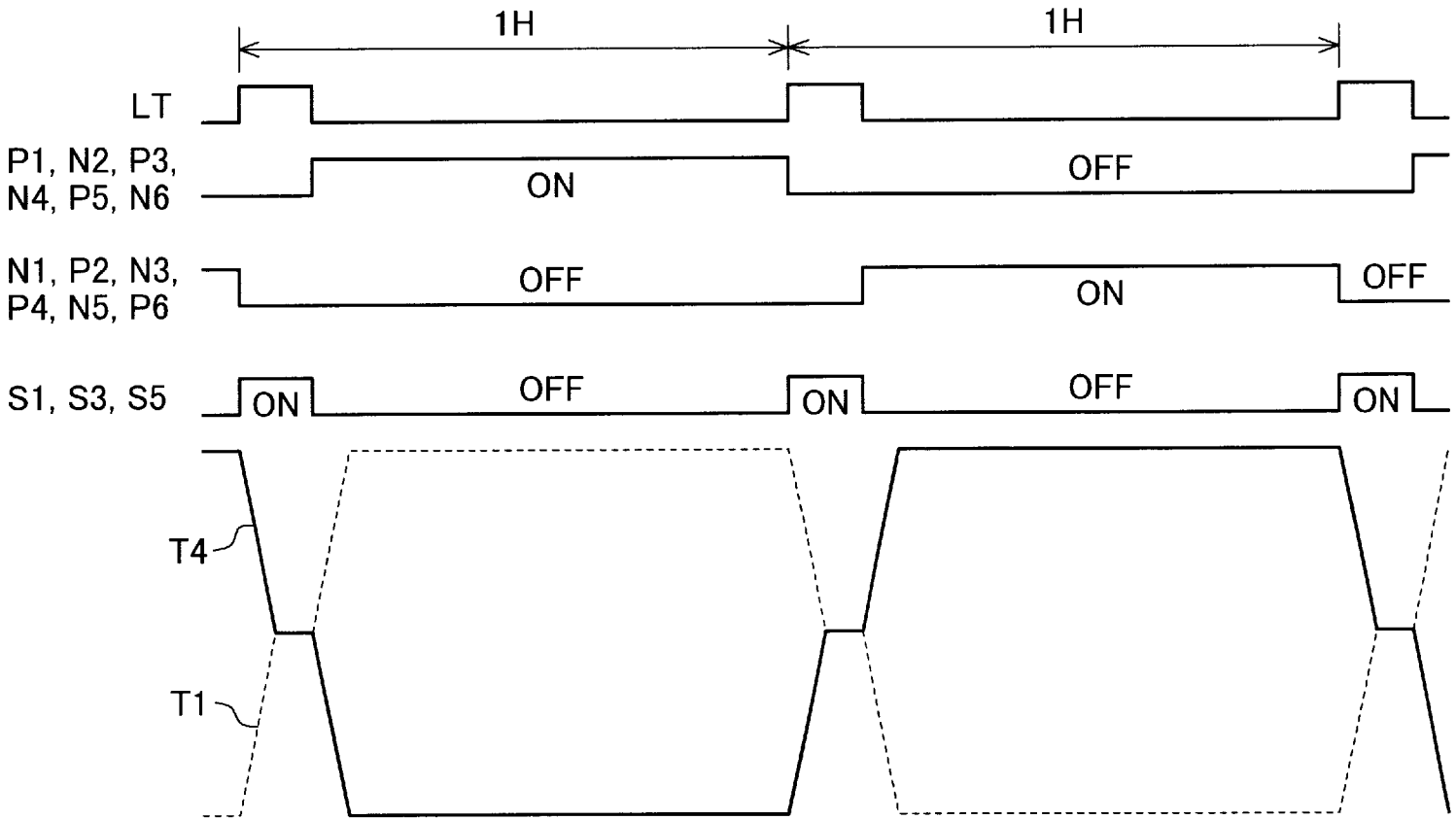
FIG. 7 is a waveform diagram showing operation of the output stage of FIG. 5.

FIG. 7 is a waveform diagram showing operation of the output stage of FIG. 5.

The latch signal LT is a pulse issued in each cycle of 1 'H', and pixel data are latched into the registers R1 to R6 on the rise of each pulse. During each pulse period of the latch signal LT, the transfer gates P1 to P6, and N1 to N6 stay off, and a high impedance state arises between the voltage buffer amplifiers and the output terminals. In this period, the short-circuiting switches S1, S3 and S5 are turned on, and thereby the voltages of the terminals connected by the short-circuiting switches are averaged.

Although preferred embodiments of the present invention has been described, it is to be understood that the invention is not limited thereto and that various changes and modifications may be made without departing from the spirit and scope of the invention.

For example, voltage buffer amplifiers may be respective source follower circuits. Further, a data driver may be formed in one piece with a LCD panel by employing thin film transistors.

What is claimed is:

1. A data driver for a liquid crystal display device having data bus lines, comprising voltage buffer amplifiers each outputting an analog gradation voltage to provide to one of said data bus lines such that voltages of every nearest two of said data bus lines with respect to a same display color are opposite to each other in polarity, said data driver further comprising:

short-circuiting switches for electrically connecting every other nearest two of said data bus lines with respect to a same display color; and a control circuit turning on said short-circuiting switches when said voltage buffer amplifiers are electrically isolated from said data bus lines.

2. The data driver of claim 1, wherein said short-circuiting switches are connected through interconnecting lines arranged in first and second rows in a staggered configuration.

3. The data driver of claim 2, wherein, in regard to each of said first and second rows, one ends of adjacent ones of said short-circuiting switches are connected to respective adjacent ones of said data bus lines.

4. The data driver of claim 3, wherein said short-circuiting switches are formed on one side of every other one of said data bus lines.

5. The data driver of claim 4, wherein each of said short-circuiting switches comprise an NMOS transistor formed on a third row and a PMOS transistor formed on a fourth row, said PMOS transistor being connected in parallel to said NMOS transistor.

6. The data driver of claim 5, wherein said interconnecting lines of said first and second rows are formed in a region between said third and fourth rows of said transistors.

7. A liquid crystal display device comprising:

an LCD panel having a plurality of data bus lines and a plurality of scan bus lines;

a scan driver connected to said plurality of scan bus lines; and a data driver comprising voltage buffer amplifiers each outputting an analog gradation voltage to provide to one of said data bus lines such that voltages of every nearest two of said data bus lines with respect to a same display color are opposite to each other in polarity, wherein said data driver further comprises:

short-circuiting switches for electrically connecting every other nearest two of said data bus lines with respect to a same display color; and a control circuit turning on said short-circuiting switches when said voltage buffer amplifiers are electrically isolated from said data bus lines.

8. The liquid crystal display device of claim 7, wherein said short-circuiting switches are connected through interconnecting lines arranged in first and second rows in a staggered configuration.

9. The liquid crystal display device of claim 8, wherein, in regard to each of said first and second rows, one ends of adjacent ones of said short-circuiting switches are connected to respective adjacent ones of said data bus lines.

10. The liquid crystal display device of claim 9, wherein said short-circuiting switches are formed on one side of every other one of said data bus lines.

11. The liquid crystal display device of claim 10, wherein each of said short-circuiting switches comprise an NMOS transistor formed on a third row and a PMOS transistor formed on a fourth row, said PMOS transistor being connected in parallel to said NMOS transistor.

12. The liquid crystal display device of claim 11, wherein said interconnecting lines of said first and second rows are formed in a region between said third and fourth rows of said transistors.

* * * * *